United States Patent [19]

Strickland et al.

[11] Patent Number: 4,466,209

[45] Date of Patent: Aug. 21, 1984

[54] LOADER FOR MUZZLE-LOADING FIREARMS

[76] Inventors: Leon Strickland, 4745 Woodview Dr.; Robert M. Foglesong, 3115 Del View, both of Del City, Okla. 73115; Terry D. Arden, 5009 Lunlow, Oklahoma City, Okla. 73135

[21] Appl. No.: 474,373

[22] Filed: Mar. 11, 1983

[51] Int. Cl.[3] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 4,050,175 | 9/1977 | Mulinix | 42/90 |
| 4,112,606 | 9/1978 | Griffin | 42/90 |
| 4,135,322 | 1/1979 | Tice et al. | 42/90 |
| 4,411,088 | 10/1983 | Wilson | 42/90 |
| 4,419,839 | 12/1983 | Wilson | 42/90 |

*Primary Examiner*—Charles T. Jordan

*Attorney, Agent, or Firm*—Robert K. Rhea

[57] ABSTRACT

A muzzle-loading device for quickly reloading a gun. The device includes a relatively short ramrod-like shaft having an axial cap closed powder containing sleeve at one end provided with a catch retaining the device within a pocket. An open end sleeve is telescopically frictionally supported by the other end of the shaft with one end of the sleeve normally gripped by a nut slidably surrounding the shaft. A projectile cap closes the other sleeve end to form a projectile chamber in which the projectile protrudes axially beyond the end of the sleeve opposite the shaft. A percussion cap clip is supported by the projectile chamber cap.

7 Claims, 8 Drawing Figures

LOADER FOR MUZZLE-LOADING FIREARMS

BACKGROUND OF THE INVENTION

1. Field of the invention

The present invention relates to muzzle-loading firearms and more particularly to a device for storing and transporting a muzzle charge and quickly reloading a muzzle-loading firearm.

The time required to load the powder, the ball or bullet and add the primer or percussion cap to a muzzle-loading gun is generally time consuming. A preselected quantity of powder is first poured into the muzzle end of the gun barrel and then a projectile, either a lubricated maxi or mini ball or a patched round ball, is inserted into the barrel. A short starter followed by the ramrod is then used to force the projectile against and compress the powder at the breech end of the barrel. A percussion cap is then placed on the primer nipple and the gun is ready for firing.

From the above description it seems obvious that the reloading of the firearm cannot be quickly accomplished unless all of the components have been previously prepared or arranged for the sequence of loading.

Obviously, the gun is loaded prior to hunting, however, a hunter frequently finds it desirable to quickly fire a second shot, as, for example, where he has missed the game with the first shot or only wounded it and a second shot is needed for the kill.

This invention provides a device to quickly reload a muzzle-loading firearm which, with a little practice, will shorten the time to reload the firearm in the field to a few seconds time.

2. Description of the prior art

A number of prior patents have been issued for storing and transporting muzzle-loads for muzzle-loading guns. Of these several patents U.S. Pat. No. 4,050,175 is believed to be most pertinent which discloses an open end cylinder or sleeve for containing a measured quantity of powder in one end portion and a ball and patch at its other end portion. The powder end portion of the sleeve is closed by a cap having a flexible strand secured thereto and encircling the neck of the hunter. The other end of the sleeve is closed by another end cap having an elongated plunger projecting therethrough and telescopically received by the sleeve for partially ramming the ball and powder home.

The principal distinction of this invention over the above described patent is that it is formed in a relatively short compact form adapted for carrying in a shirt pocket, or the like, and characterized by a measured powder container at one end, a short ramrod throughout most of its length with a lubricated projectile holder removably secured axially to its ramrod end opposite the powder container wherein the projectile is axially started into the barrel before employing the ramrod portion to partially force it home.

SUMMARY OF THE INVENTION

The loader comprises a cylindrical container for holding a measured quantity of powder. One end of the container is closed by a cap and its periphery is provided with a clip or clasp for gripping fabric, such as a shirt pocket. The other end of the container is closed and axially connected with a shaft or rod dimensioned to be loosely received longitudinally by the bore of a gun barrel which replaces the short starter. A sleeve-like projectile chamber is frictionally secured to the end of the shaft opposite the container with its other end closed by a friction cap supporting a plurality of percussion caps opposite the sleeve.

The principal object of this invention is to provide a muzzle-loading device of relatively small configuration having a powder container containing a measured amount of readily accessible powder and slidably supporting a projectile in a chamber at its other end and for ready insertion into the muzzle end of the barrel in which a shaft connecting the powder container with the projectile chamber may be telescoped through the projectile chamber to partially ram the projectile into the gun barrel for quickly and easily reloading the muzzle-loading firearm.

DESCRIPTION OF THE PREFERRED EMBODIMENT

Figures 1, 2, 3, 4, 5, 6, 7, 8:
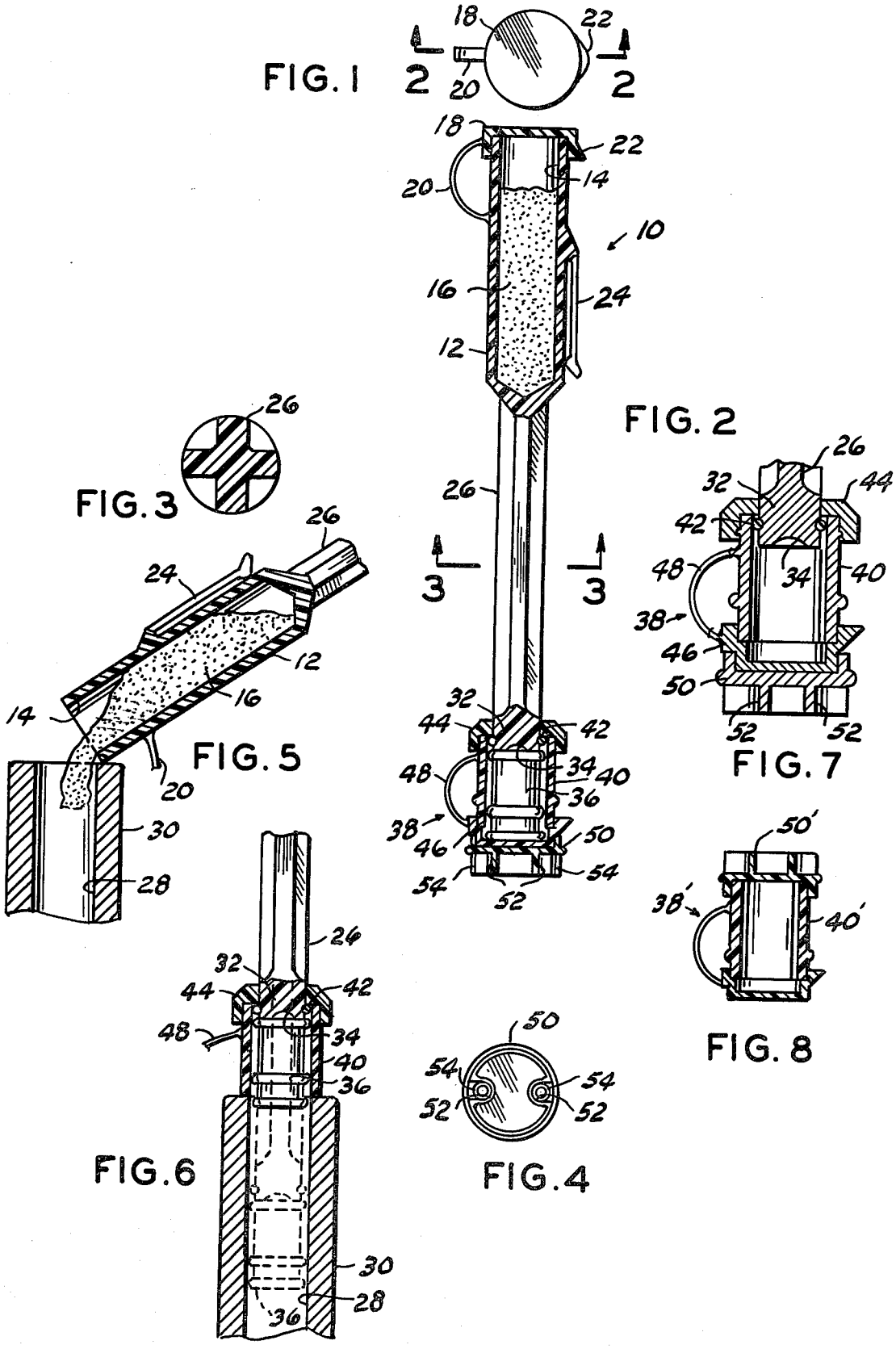
FIG. 1 is a top end view of the device.
FIG. 2 is a vertical cross sectional view taken substantially along the line 2—2 of FIG. 1.
FIG. 3 is a horizontal sectional view, to a larger scale, taken substantially along the line 3—3 of FIG. 2.
FIG. 4 is a bottom end view of a percussion cap holder supporting a pair of percussion caps.
FIG. 5 is a fragmentary cross sectional view illustrating pouring gun powder into the muzzle of a barrel.
FIG. 6 is a fragmentary vertical cross sectional view illustrating the placement and insertion of the projectile.
FIG. 7 is a fragmentary vertical cross sectional view, to a larger scale, of the projectile chamber and depending end portion of the shaft; and, FIG. 8 is a vertical cross sectional view of an auxiliary projectile containing chamber and percussion cap support.

Like characters of reference designate like parts in those figures of the drawings in which they occur.

In the drawings:

The reference numeral 10 indicates the loader, as a whole, which is cylindrical in general configuration and approximately five inches long and formed from plastic material in the preferred embodiment.

The loader comprises an elongated sleeve portion 12 forming a powder chamber 14 for containing a selected quantity of powder 16. The open end of the container or sleeve is normally closed by a frictionally engaged cap 18 tethered to the periphery of the container by a flexible strap 20 and having a lip portion 22 opposite the strap for easily removing the cap 18. The sleeve 12 is provided with a clip or clasp 24 for holding the device in a shirt pocket, or the like, not shown. The other or closed end of the sleeve is axially connected with an elongated rod or shaft 26, forming a short ramrod, preferably diametrically dimensioned to be freely received in longitudinal sliding relation by the bore 28 of a gun barrel 30 (FIG. 6).

As shown by FIG. 3, the shaft 26 is preferably cross-shaped in cross section for rigidity and reducing the mass of the device. The shaft 26 terminates opposite the sleeve 12 in a circular end portion 32 provided with an axial part-circular recess 34 for nesting the adjacent end of a projectile 36. The projectile 36 may be a maxi or mini projectile or a round ball, not shown, and conventionally grease covered which tends to maintain the projectile in the projectile chamber, indicated generally at 38. The projectile chamber comprises a short open end sleeve 40 having one of its end portions surrounding a portion of the shaft end portion 32 and frictionally secured thereto by an O-ring 42 surrounding the shaft. A sleeve nut 44 is slidable on the shaft 26 and frictionally engages the adjacent outer peripheral end portion of the sleeve 40. The other end of the projectile chamber sleeve 40 is closed by a projectile chamber cap 46 similar to the powder chamber cap 18 and similarly tethered to the sleeve 40 by a flexible strand 48.

As best shown by FIG. 7, the wall of the projectile chamber cap 46 is diametrically reduced intermediate its ends to provide a cap and peripheral surface, opposite the sleeve 40, diametrically equal with the sleeve, for the purposes presently explained.

A cap-like percussion clip 50 frictionally overlies the end surface of the projectile chamber cap 46 opposite the sleeve 40 and is provided on its depending end surface, as viewed in FIG. 4, with a pair of downward and laterally open generally U-shaped sockets 52 disposed in diametric opposition for frictionally receiving and respectively supporting a pair of conventional percussion caps 54.

As illustrated by FIG. 8, a second projectile chamber 38' is provided and is substantially identical to the projectile chamber 38 with one end of the sleeve 40' closed by a percussion cap clip 50'. The purpose of the second chamber 38' is for carrying a one or more different or alike projectiles. For example, a maxi or mini projectile may be preloaded in the gun and a prelubed projectile placed in the auxiliary chamber 38' to replace the projectile in the device 10 while in the field.

OPERATION

In operation, the loader 10 is provided with the projectile 36, percussion cap 54 and a measured quantity of powder 16 and with the caps 18, 46 and 50, in place is carried in a pocket of the hunter. In the event the hunter desires to fire a second shot, he removes the cap 18 and pours the powder 16 into the rifle barrel 30, as illustrated by FIG. 5. The projectile chamber cap 46 is then removed and the device 10 axially aligned with the barrel 30 wherein the end of the projectile 36, projecting beyond the sleeve wall 40, centers the device over the barrel so that the shaft 26 may be telescoped through the nut 44 and into the bore of the barrel thus forcing the projectile 36 and powder the full length of the shaft into the barrel 30. The rifle ramrod, not shown, is then used, after removing the device 10, to ram the projectile and powder home. The percussion cap 54, supported by the clip 50, in turn supported by the projectile chamber cap 46, is then easily applied to the breech nipple by holding the clip 50 while moving it away from the percussion cap after the latter has been placed in position on the nipple.

Obviously the invention is susceptible to changes or alterations without defeating its practicability. Therefore, we do not wish to be confined to the preferred embodiment shown in the drawings and described herein.

We claim:

1. A muzzle-loading device for carrying materials for muzzle-loading firearms, comprising:

an elongated shaft having an elongated powder sleeve axially projecting from one end for holding a gunpowder charge;

a first cap closing the end of said sleeve opposite the shaft;

projectile chamber means including a projectile surrounding sleeve axially projecting beyond the other end portion of said shaft for telescoping movement of said shaft through the projectile sleeve; and, a second cap closing the end of the projectile sleeve opposite said shaft.

2. The muzzle-loading device according to claim 1 in which said projectile chamber means further includes:

a sleeve nut longitudinally slidably surrounding said shaft other end portion and frictionally gripping the adjacent end portion of said projectile sleeve.

3. The muzzle-loading device according to claim 2 and further including:

means for normally preventing axial separation of said sleeve nut and said shaft.

4. The muzzle-loading device according to claim 2 and further including:

cap-like clip means normally supported by said second cap for supporting a percussion cap.

5. The muzzle-loading device according to claim 4 in which said clip means includes:

at least one axial and radially open socket on one end of said clip means for frictionally gripping a percussion cap.

6. The muzzle-loading device according to claim 5 and further including:

other clip means on said powder sleeve for securing it to a support.

7. The muzzle-loading device according to claim 2 in which the length of said projectile sleeve is at least less than the axial length of a projectile when disposed therein.

* * * * *